US006796457B2

(12) United States Patent
Sperber

(10) Patent No.: US 6,796,457 B2
(45) Date of Patent: Sep. 28, 2004

(54) MATERIAL FEEDER

(75) Inventor: Henry Sperber, Englewood, CO (US)

(73) Assignee: Ark Seal, LLC, Denver, CO (US)

( * ) Notice: Subject to any disclaimer, the term of this patent is extended or adjusted under 35 U.S.C. 154(b) by 87 days.

(21) Appl. No.: 10/146,630

(22) Filed: May 14, 2002

(65) Prior Publication Data

US 2003/0215292 A1 Nov. 20, 2003

(51) Int. Cl.[7] ..... B67B 7/00
(52) U.S. Cl. ..... 222/1; 222/636; 222/370
(58) Field of Search ..... 222/1, 367, 370, 222/630, 636

(56) References Cited

U.S. PATENT DOCUMENTS 4,450,790 A * 5/1984 Stansbury, Jr. ..... 119/51.12
4,671,210 A * 6/1987 Robinson et al. ..... 119/51.12
4,978,252 A 12/1990 Sperber ..... 406/64
5,150,664 A * 9/1992 Kirk ..... 119/51.12
5,249,860 A * 10/1993 Buschbom et al. ..... 366/135
5,647,696 A 7/1997 Sperber ..... 406/56
5,829,649 A * 11/1998 Horton ..... 222/636
5,915,581 A * 6/1999 Pfirrmann et al. ..... 220/4.21

FOREIGN PATENT DOCUMENTS

WO WO 01/10757 A1 2/2001

* cited by examiner

*Primary Examiner*—Patrick M Buechner
(74) *Attorney, Agent, or Firm*—Sheridan Ross P.C.

(57) ABSTRACT

A material feeder is provided that includes a drum having a number of compartments that receive material that is to be output by the feeder. The material can be any one of many different materials that are usually light and/or smaller in size, such as insulation, powders, grains and the like. At least a first seal is provided adjacent to the drum to close off an end of each compartment during some of its rotation. The first seal is preferably stationary during rotation of the drum and its compartments. The position of the seal relative to the drum can be adjusted to provide desired positioning between the seal and the drum. In one embodiment, the first seal is in contact with at least portions of the first end of the drum. The material is delivered to each compartment in the drum preferably using first and second fillers that are mounted adjacent to and outwardly of first and second ends of the drum.

8 Claims, 8 Drawing Sheets

MATERIAL FEEDER

FIELD OF THE INVENTION

The present invention relates to a feeder apparatus and method that provides compartments to carry material to be output from the apparatus.

BACKGROUND OF THE INVENTION

Apparatuses for delivery of materials under pressure have been previously devised. These materials can include powders, grains, insulation, as well as other materials that may typically be relatively light and/or relatively small. These apparatuses can include a bin for holding the material from which the material subsequently moves into an area where pressurized air is supplied. The pressurized air in contact with the material is used to force the material from the apparatus. In one known application, a hopper holds insulation that is to be blown into building cavities using pressurized air. In this insulation apparatus, compartments are formed that receive insulation that is to be output using the pressurized air. The compartments are defined using combinations of vanes and seals that are connected together and with the seals engaging a stationary drum as the compartments rotate. This prior art implementation requires, after some time, that the seals be replaced. Replacement of the seals can involve a significant amount of time.

Notwithstanding the use and/or advancement of prior art material feeders, it would be beneficial to provide a material feeder that is easy to assemble, has fewer parts, and in which adjustment and/or replacement of seals can be facilitated.

SUMMARY OF THE INVENTION

In accordance with the presence invention, a material feeder is provided that includes a rotatable drum or wheel having a number of defined compartments. The compartments receive and rotatably carry material until it is output using pressurized air. At least a first seal is utilized in holding the material in the compartment, during at least some of the rotation of the drum. The first seal remains stationary during rotation of the drum and its compartments. The first seal can be readily assembled, adjusted and replaced relative to and independently of the drum, including independently of any configuration change to the drum. That is, the first seal is not part of the drum and is not used in configuring the drum to create compartments. To control output of material from the feeder apparatus, a variable mechanism can be linked to the drum useful in regulating drum speed (revolutions per minute).

The drum has a first end and second end with a length therebetween. The first seal is located or positionable adjacent to the first end. Preferably, there is a second seal that is located or positionable relative to the second end of the drum. Each seal can include a seal plate and a seal pad that is joined to the seal plate. Each seal can be joined to its respective drum end using one or more fasteners. One or more of the fasteners can be adjustably moved, preferably turned, to adjust the position of the seal pad relative to its respective end. The seal pad can be made of a relatively rigid material that is typically non-metallic. When a seal is properly positioned relative to the drum and its compartments, at least for some of the time during the rotation of the compartments, such as at least a majority of the time, the seal closes off an opening associated with a compartment to hold the material in the compartment.

In one embodiment, at least the first seal has an inner surface area that is less than the outer surface area of the first end of the drum. This difference in surface area leaves an opening in the upper half of the drum end at its upper portions, at any instance in time during the rotation of the drum. This opening defines an inlet at the first end of the drum for material to be fed into and received by at least one particular rotating compartment that is currently at this inlet. A rotatable first filler is mounted adjacent to the drum first end and outwardly thereof for use in moving or feeding material into each compartment as it opens at its compartment end during drum rotation. Preferably and symmetrically, a second rotatable filler is mounted adjacent the second end of the drum outwardly thereof for use in feeding or providing material into the same compartment but at its second end. In one embodiment, each of the two fillers can have a shaft from which a plurality of tines extend into a chamber that contains material to be fed into the drum compartments.

With respect to operation or use of the material feeder, once the first and/or second seal is properly positioned relative to its respective drum end using one or more of the adjustable fasteners, the material feeder can be activated for delivering or outputting material, such as insulation therefrom. More specifically, material is provided or made available on a continuous basis adjacent to the first and second fillers, which are powered to cause their rotation. The drum is also powered and rotating using a drum shaft. During a cycle based on one drum rotation or revolution, each compartment of the drum is exposed or open during a portion of the cycle. When this occurs, the two fillers feed material into the particular compartment(s) at opposite open ends of the compartment(s). For that particular compartment(s), it (they) will subsequently rotate relatively downwardly. Once in a predetermined, downward position, the material in the compartment(s) is contacted or engaged by pressurized air. Such exposure to the pressurized air is due to an inlet hole formed in one seal and an outlet hole formed in the other of the two seals at their lower portions. When the pressurized air comes in contact with the material, it forces the material from the particular compartment in a direction from the second end of the drum to the first end of the drum and such material exits the drum from the outlet hole in the first end. After being forced from the drum, conventional or traditional hardware, such as a coupling, tube, hose or the like, can be used to carry the material to the desired destination. In one embodiment, the material can be insulation (e.g., insulating particles) that is carried from the feeder apparatus to a building cavity that is to be insulated. In other embodiments, the material can be powders, grains, relatively light and/or relatively small particles or other objects that are to be carried to a desired destination.

Based on the foregoing summary, a number of key advantages of the present invention are immediately recognized. A feeder apparatus is provided that effectively outputs material under pressure using a number of material-carrying compartments that can be sealed off, at least some of the time that the drum rotates. The one or more seals are preferably stationary, while the compartments rotate thereagainst to close off the openings until controlled escape of the material from a particular compartment is intended. Each seal is easy to assemble or position relative to the drum and can be adjusted to provide desired contact with the drum during its rotation. Each seal is configured and arranged to facilitate replacement thereof. In one embodiment, a seal is positioned at opposite ends of the length of the drum. In another embodiment, one or more seals could be utilized along the length of the drum. Because of the arrangement and configuration of these seals, fewer parts may be necessary in the feeder apparatus. In one embodiment, the rate at which the material is output from the feeder apparatus can be regulated by controlling rotation of the drum and its compartments.

Additional advantages of the present invention will become readily apparent from the following discussion, particularly when taken together with the accompanying drawings.

DETAILED DESCRIPTION

Figure 1:
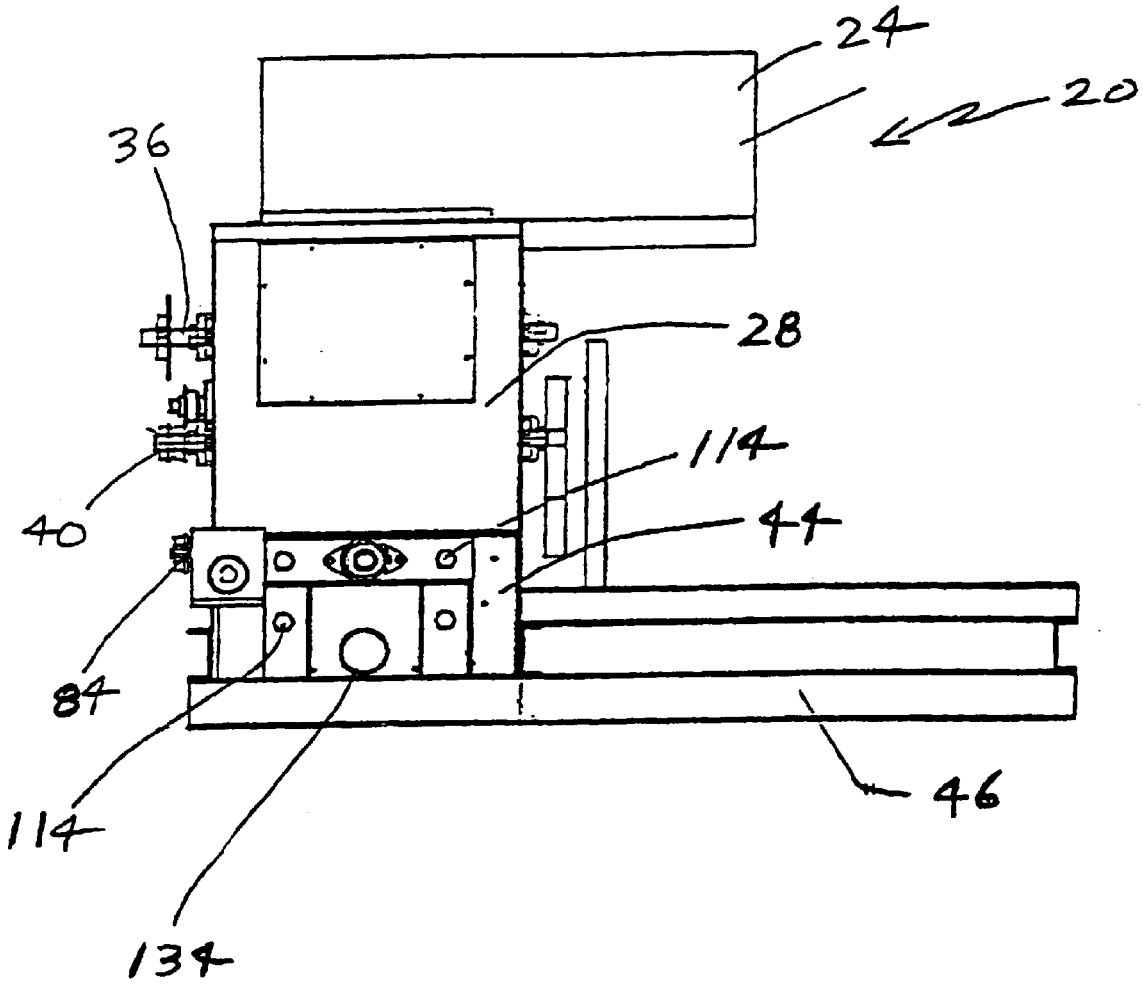
FIG. 1 illustrates an end elevational view of a feeder apparatus of the present invention.

A feeder apparatus 20 is depicted in FIG. 1. The feeder apparatus 20 can receive material and output the material under force or pressure. Pressurized air can be provided to engage the material at a desired time and force it from the apparatus 20. Although the material can be selected from a number of different materials, such as light materials, small materials, grains, powders and materials having similar constituencies, the following describes the apparatus 20 in terms of it being used with insulation or insulating particles. The insulating particles are blown from the apparatus 20 for subsequent delivery to a building cavity or other item for insulation purposes.

Figure 2:
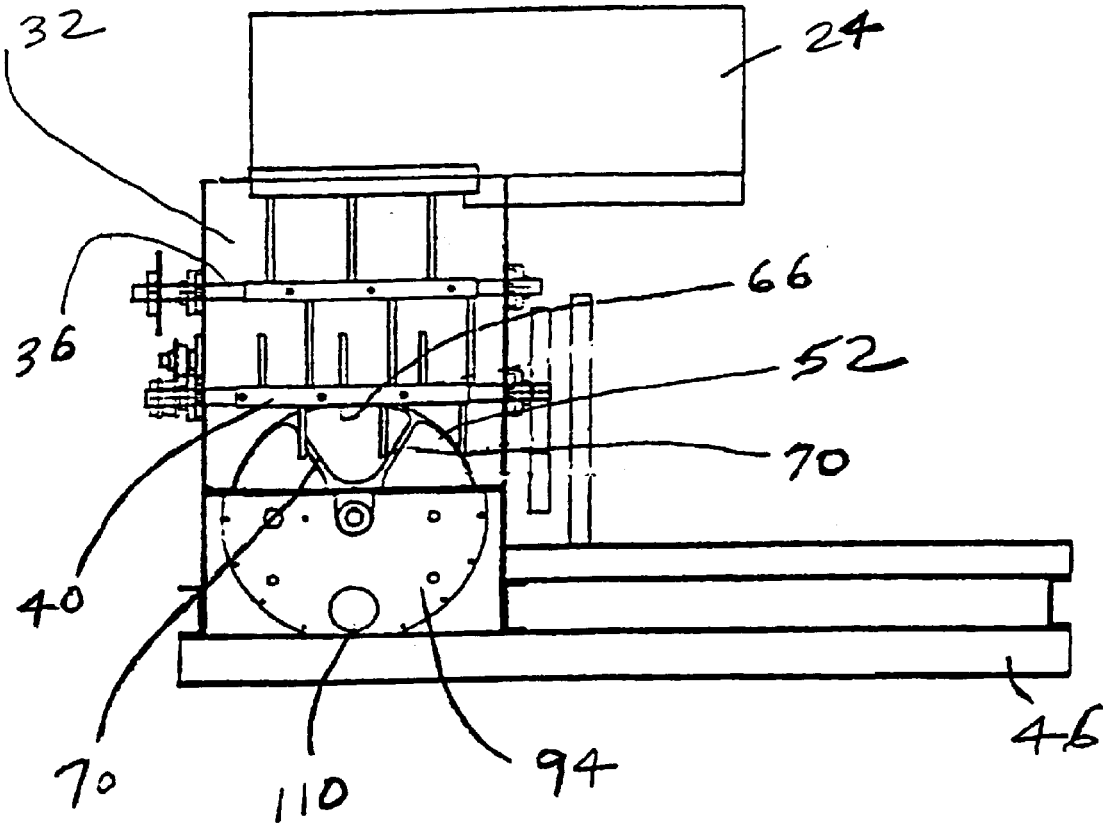
FIG. 2 is similar to FIG. 1 but with inner parts of the feeder apparatus being exposed including a first seal and a first filler.

The feeder apparatus 20 includes a hopper or bin 24 into which the material, such as insulation material is placed. The hopper 24 is joined to a feed body 28 having a number of walls which define a chamber 32, as noted in FIG. 2. A main tine assembly 36 is disposed in upper parts of the chamber 32. The main tine assembly 36 is useful in removing or carrying the insulating particles from the hopper 24. As also seen in FIG. 2, a first filler 40 is disposed below the main tine assembly 36 and is similar in configuration and operation to the main tine assembly 36. Typically, the first filler 40 is smaller in size than the main tine assembly 36. In that regard, in one embodiment, the first filler 40 is a tine subassembly that is located essentially in front of a material conveyor subassembly 44, or at least substantial portions thereof are located outwardly of the material conveyor subassembly 44. A base frame 46 supports the material conveyor subassembly 44. The material conveyer subassembly 44 includes important hardware for controllably removing the material from the feeder apparatus 20. As noted in the side view of FIG. 3 and best seen in FIGS. 4 and 5, in the preferred embodiment, the chamber 32 houses a second filler 48, which can be the same in design, structure and operation as the first filler 40. The second filler 48 is disposed, or at least substantial portions thereof are disposed, in front of the end of the material conveyor subassembly 44 that is opposite the end at which the first filler 40 is adjacent. The main tine assembly 36 and the first and second fillers 40, 48 have rotatable shafts that can be motor driven using various couplings, linkages, or other suitable connections that might include gears, sprockets, pulleys, chains and the like.

The material conveyor subassembly 44 includes a rotatable drum or wheel 52 as noted in FIG. 2. Illustrations of the drum 52 are provided in FIGS. 4–7. The drum 52 includes first and second opposite ends 56, 60, respectively, and a length defined therebetween. The drum 52 has a number of compartments or tubes 66, each of which can be designated with individual reference number 66*a*, 66*b* . . . In one embodiment, there are six compartments 66*a* . . . 66*f*. With respect to forming or defining the compartments 66, each has two webs 70 that extend between the first end 56 and the second end 60 of the drum 52. Also used in defining the compartments 66 are a number of covers 74 and with each of those able to be designated by an individual reference number 74*a*, 74*b* . . . The number of covers 74*a* . . . 74*f* corresponds to the number of compartments 66*a* . . . 66*f*. The cover 74 locks or seals off its respective compartment 66 along its length and two webs 70 extend along the length of the drum 52 between ends of a particular cover 74. In accordance with this embodiment, once material is fed into the drum 52, it cannot escape outwardly along the length of the drum 52 due to the covers 74.

Figure 3:
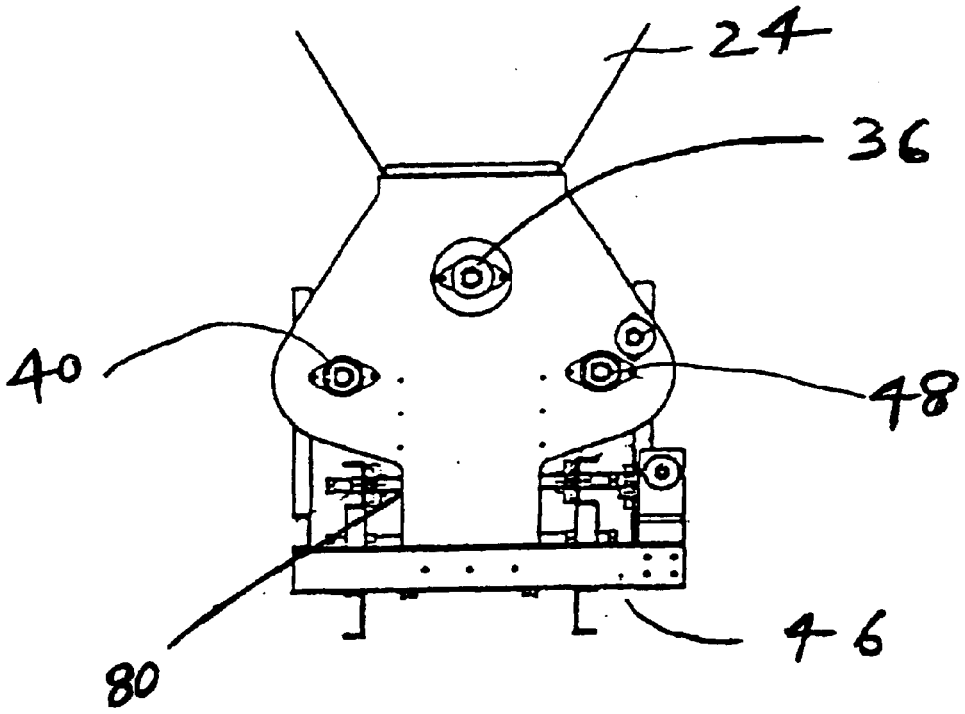
FIG. 3 illustrates a side elevational view of the feeder that indicates the length of the drum and positions associated with the first and second seals and the first and second fillers.
Figure 4:
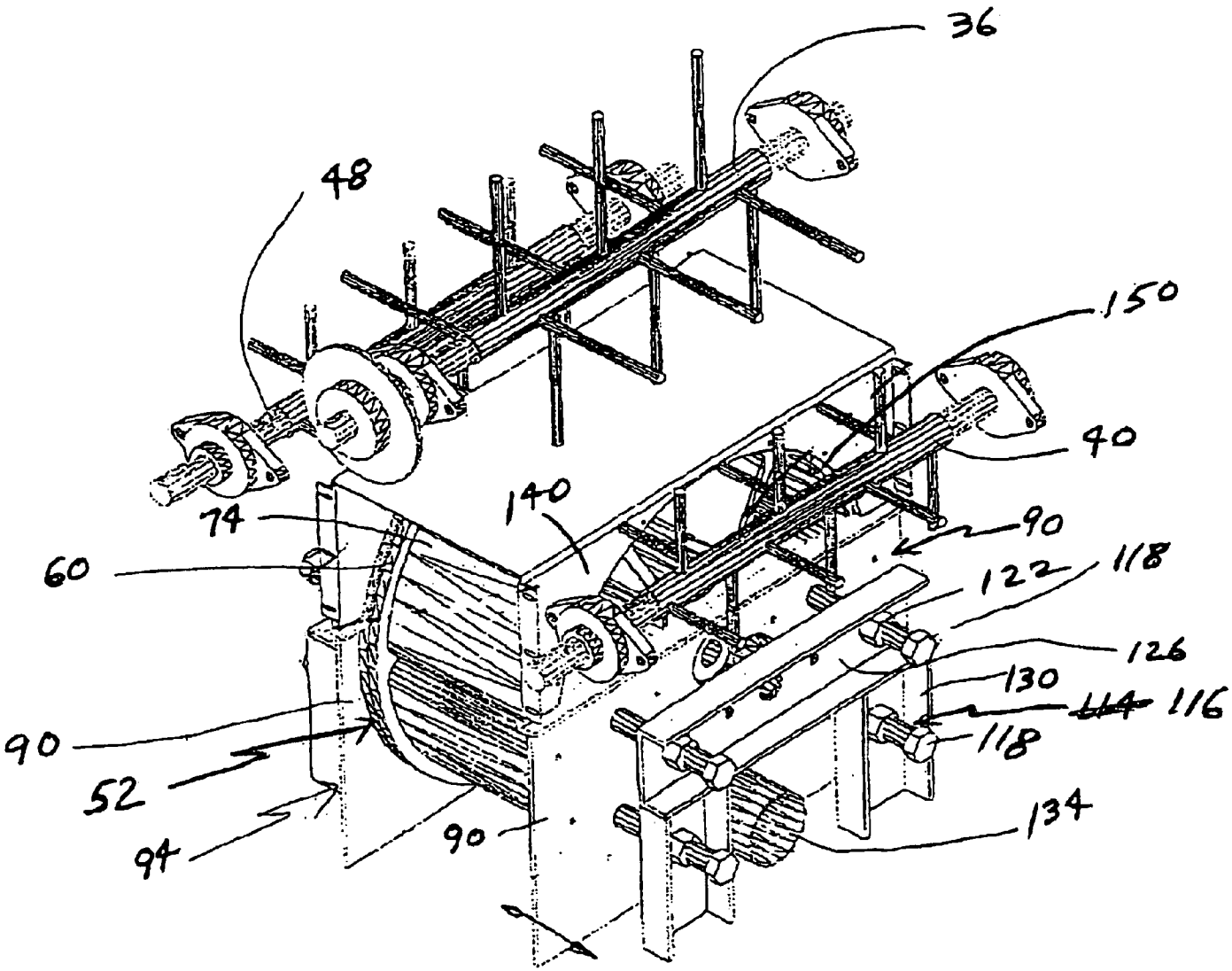
FIG. 4 is a perspective view illustrating an adjustable seal and fillers arranged relative to the drum.
Figure 5:
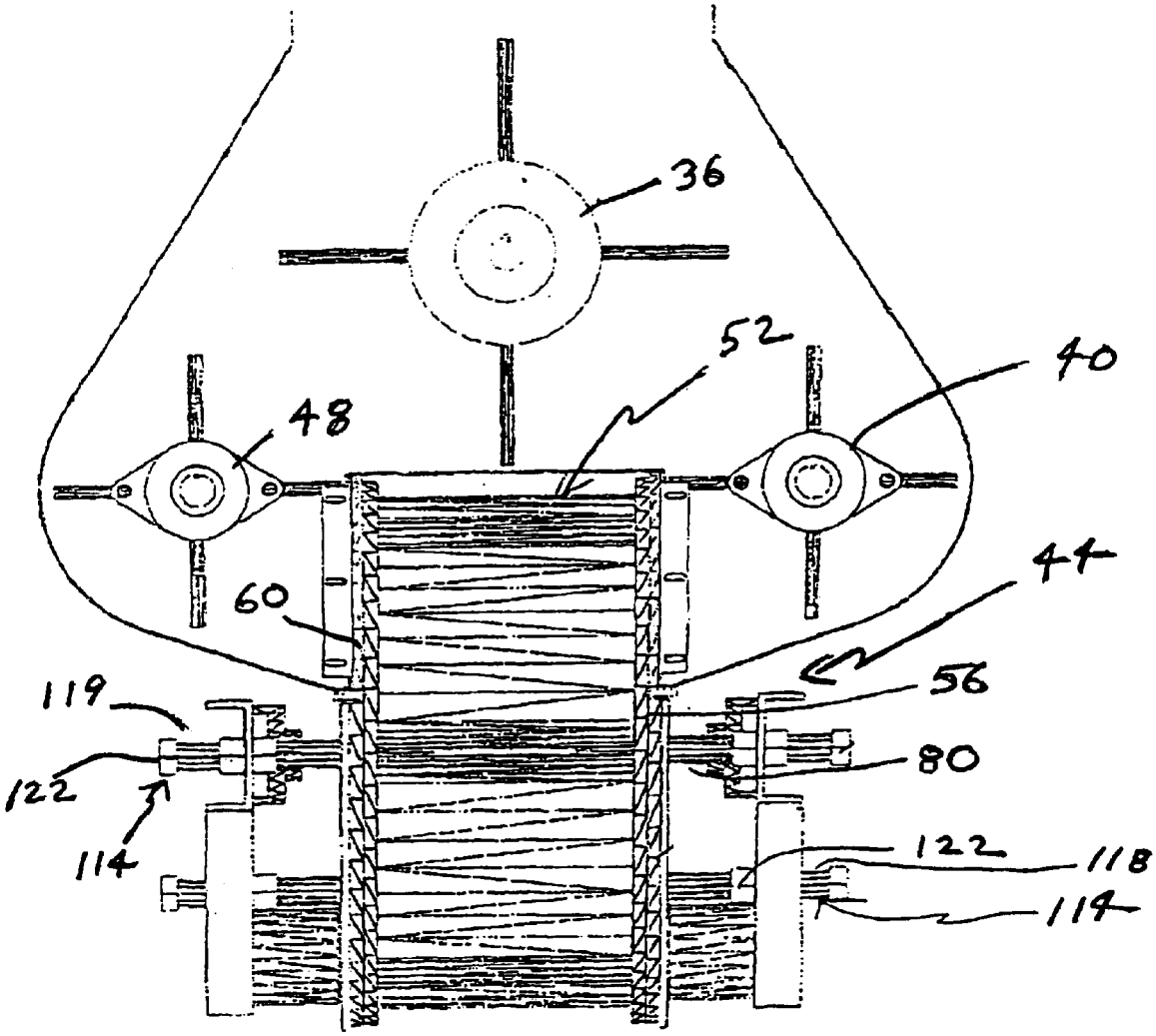
FIG. 5 illustrates a top a view of the feeder apparatus components depicted in FIG. 4.
Figure 6:
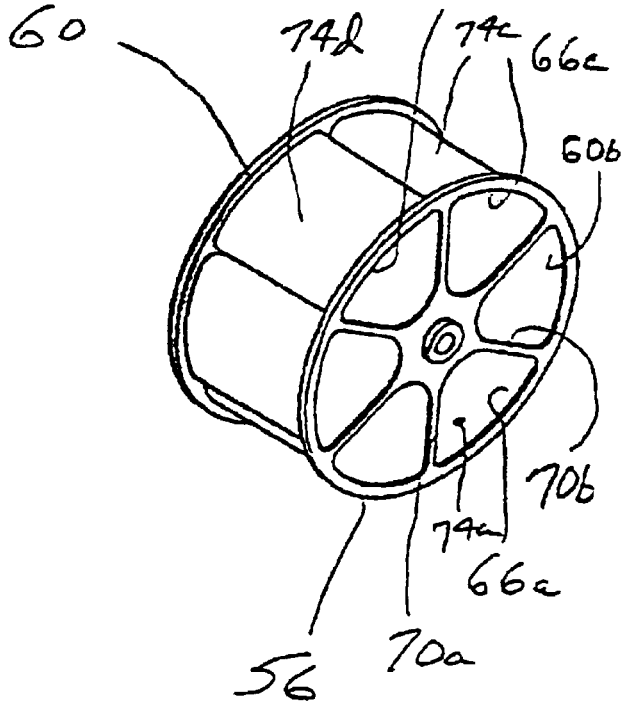
FIG. 6 illustrates a perspective view of the drum.
Figure 7:
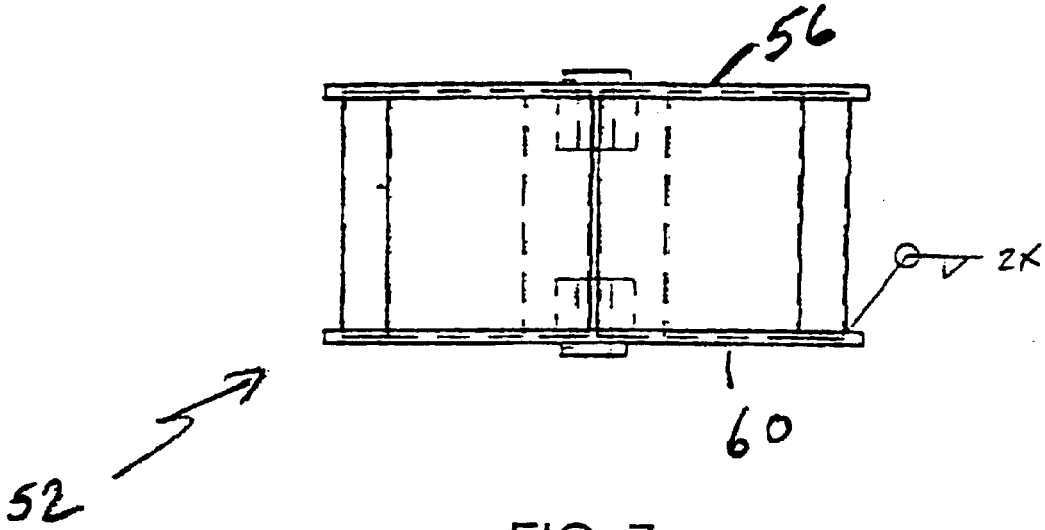
FIG. 7 illustrates a side view of the drum of FIG. 6.

Referring to FIG. 4, when the feeder apparatus 20 is being used or operated, the material to be output by the feeder apparatus 20 is input or delivered to a compartment 66 using the first and second fillers 40, 48. The fillers 40, 48 cause the material to be fed into the ends or inlets associated with the compartments at the opposite ends 56, 60 of the drum 52. The drum 52 rotates during this feeding of material. A drum shaft 80, as illustrated in FIG. 3, is driven to rotate at a selected, desired speed. In one embodiment, as represented in FIG. 1, a variable speed right angle gear box 84 is employed to adjust the speed of the drum shaft 80 and thereby the rotational speed of the drum 52.

Figure 8:
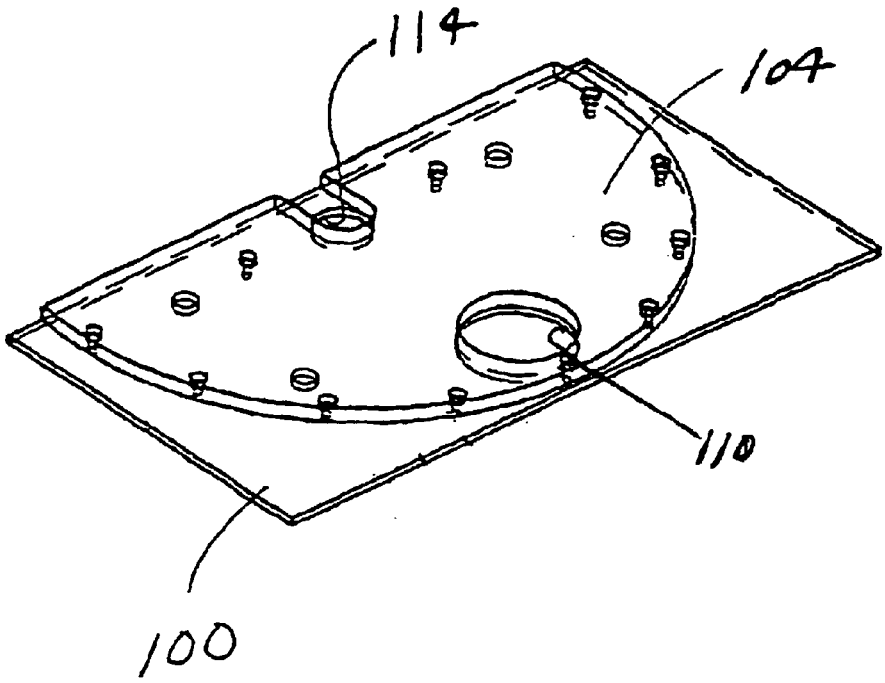
FIG. 8 illustrates a perspective view of a seal.

Important to maintaining the material in the drum 52, for at least some of the time during its rotation, is a structure for holding the material in place once it is received by the drum 52 until it is to be output therefrom. In one embodiment, such a material holder includes at least a first seal and, preferably, a second seal. In the preferred embodiment, the first and second seals are located adjacent the ends 56, 60 of the drum 52. More specifically, referring to FIGS. 2 and 8–9, a first seal 90 is positioned adjacent to the drum first end 56 and the second seal 94 is positioned adjacent to the drum second end 60. Although the first and second seals 90, 94 could be integral or one-piece elements, in the preferred embodiment, each of the first and second seals 90, 94 has at least a seal plate 100 and a seal pad 104, as best illustrated in FIG. 8. The seal plate 100 can be a rectangular shaped plate that can be made substantially of metal. The seal pad 104 can be essentially a curved piece, such as a hemispherical unit, with its diameter different from the length of the seal plate 100. The seal pad 104 can be joined to the seal plate 100 by desired or suitable fastening, such as by screws, bolts, rivets and the like, or a strong bonding material or adhesive might be used to join them together. Through each of the seal plate 100 and the seal pad 104 of the first seal 90, a seal outlet 110 is formed that is located opposite from the diameter of the hemispherical side of the seal pad 104. Similarly, an inlet (not shown) is formed through the second seal 94 that is in axial alignment with the seal outlet 110. A bore 114 is also formed through both the seal plate 100 and the seal pad 104 of each seal 90, 94 to provide access for the drum shaft 80. The seal pad 104 can be made of any material that achieves the desired function of providing a barrier or seal for material in the compartment 66 of the drum 52 as it rotates so that the material is held in the compartment 66 until each compartment 66 is positioned in alignment with the seal outlet 110. In one embodiment, the seal pad 104 is made of a relatively rigid, substantially non-metallic material. Since the seal pad 104 is hemispherical in shape and each end 56, 60 of the drum 52 is circular in shape, the surface area of the seal pad 104 is less than the surface area of each of these two ends 56, 60.

In connection with joining each of the first and second seals 90,94 to its respective drum end 56, 60, a number of adjustable fasteners 116 are employed. The adjustable fasteners 116 can include a number of adjusting bolts 118 on each of which is positioned or threaded an adjusting nut 122. Each adjusting bolt 118 can be positioned through a flange plate. In one embodiment, upper adjusting bolts 118 are provided through an upper flange plate 126 and lower adjusting bolts are positioned through a lower flange plate 130. Each of the two flange plates 126, 130 is disposed outwardly of a seal, as best seen in conjunction with the first seal 90. The adjusting bolts 118 extend from one of the two flange plates 126, 130 into the seal plate 100 and extend at least partially through the thickness of the seal pad 104. The adjusting bolts 118 can be turned clockwise or counterclockwise in connection with moving the seal pad 104 relative to the drum end to which it is adjacent. This is important in providing the proper contact or other arrangement between the seal pad 104 and the particular drum end in connection with controlling the escape of material that is being carried by the compartment 66. For example, during assembly of the feeder apparatus 20, each seal 90, 94 is properly positioned near its respective drum end 56, 60 to hold the material in place in the particular compartment 66 until it is allowed to escape from the outlet hole 110. This is accomplished without interfering with the proper or desired rotational movement of the drum 52. In another example, after assembly of the feeder apparatus 20, and either before or after some use of the feeder apparatus 20 by an owner or user thereof, the position of one or both seals 90, 94 can be adjusted relative to its respective drum end 56, 60. This design or configuration of seals and adjustable fasteners enables the user to readily control the relative positioning between the seals 90, 94 and the drum ends 56, 60. In still another aspect, the seals 90, 94 are easy to replace when worn or have served their useful life. A worn seal can be removed from adjacent its drum end. The seal pad 104 could be removed from the seal plate 100 and replaced by a new seal pad. Alternatively, both the seal plate 100 and the seal pad 104 could be replaced with a new seal plate 100 and seal pad 104.

With regard to removing or carrying material away from the drum 52, particularly the compartment 66 that is then aligned with the outlet hole 110, an outlet coupler 134 can be utilized that is joined to the first seal 90. More specifically, pressurized air is delivered to the seal inlet formed in the second seal 94 and comes in contact with the compartment 66 that is then aligned with the seal outlet 110 in the first seal 90. The pressurized air through the seal inlet pushes or causes movement of the material from the aligned compartment 66 through the seal outlet 110 and into the outlet coupler 134. In the embodiment in which the feeder apparatus 20 is involved with outputting insulating particles, a hose can be connected to the outlet coupler 134 which carries the insulating particles to the building cavity or other object to be insulated.

Figure 9:
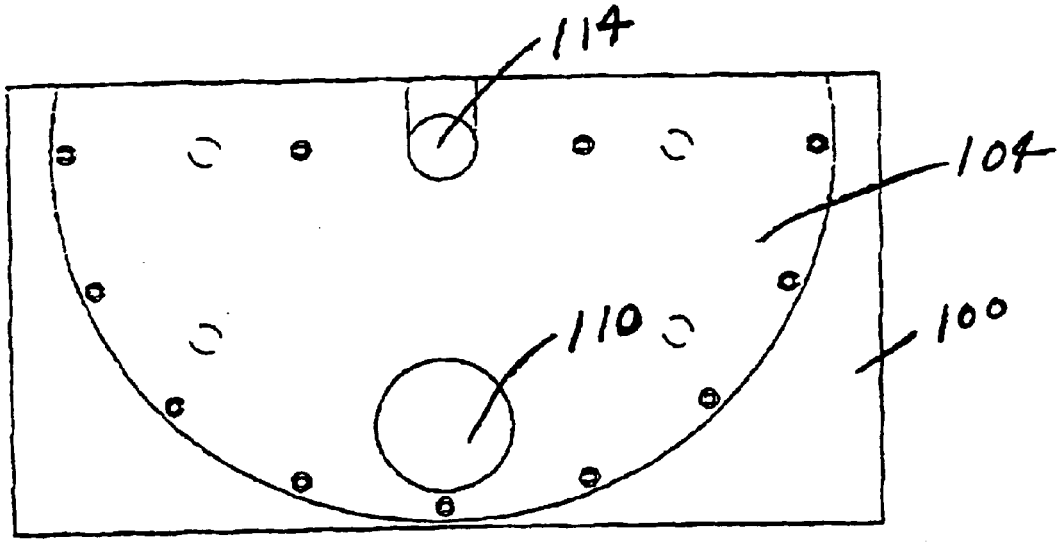
FIG. 9 illustrates a front view of the seal of FIG. 9.
Figure 10:
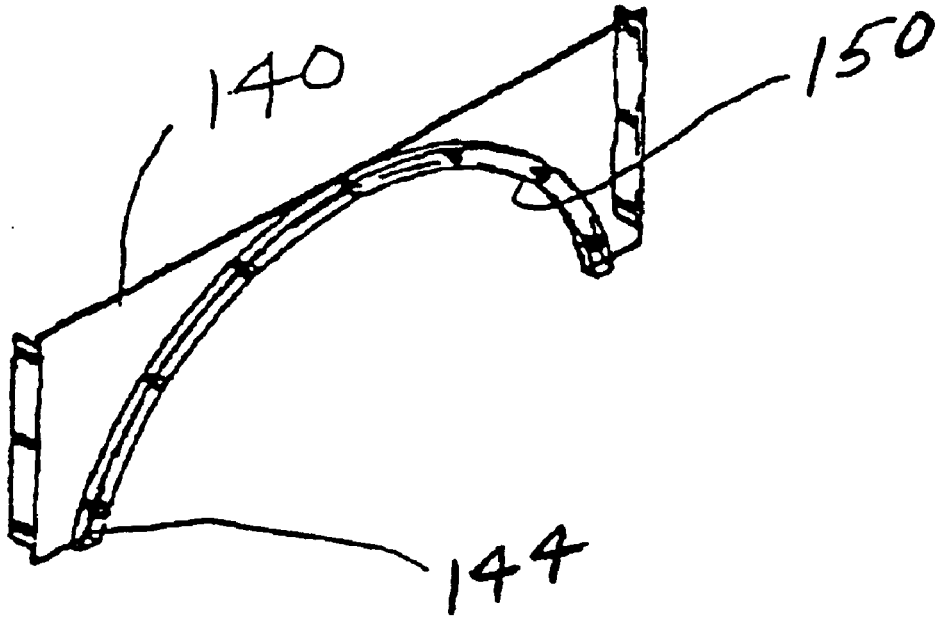
FIG. 10 illustrates a perspective view of a cover plate to be located above a seal and having an opening for use in providing access to drum compartment ends during their rotation.

Referring to FIGS. 9 and 10, an upper plate 140 is illustrated that is joined to the body 28 of the feeder apparatus 20 above a seal. Like the seals 90, 94, in the preferred embodiment, there are two upper plates 140, with one being joined to the feed body 28 at the opposing ends 56, 60 of the drum 52. Each of the upper plates 140 can include a curved seal strip 144 that defines the border of a generally hemispherical opening 150. The hemispherical opening 150 is aligned with current upper portions of the drum 52 during its rotation. The hemispherical opening 150 is aligned with at least one drum compartment 66 at all times during the rotation of the drum 52. The opening 150 provides access to at least one end of a drum compartment 66 that is currently aligned therewith during drum rotation so that the fillers 40, 48 can be used to feed material through the hemispherical opening 150 into the particular compartment end.

Although the preferred embodiment that has been described includes seals 90, 94 at opposite ends of the drum 52, one or more seals could be configured that are curved and which extend along the length of the drum 52. In such an embodiment, the covers 74 need not be used and could be removed, or at least there would be sufficient exposure to enable the material to be fed into the drum along its length. Each of the one or more curved seals would also be adjustably positioned relative to the length of the drum 52. In such an embodiment, other than an inlet through one end of the drum 52 and an outlet through the other end of the drum 52, the two ends of the drum 52 could be covered so that no material could escape past such barrier, except through the outlet hole.

The foregoing discussion of the invention has been presented for purposes of illustration and description. Further, the description is not intended to limit the invention to the formed disclosed herein. Variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include alternative embodiments to the extent permitted by the prior art.

What is claimed is:

1. A method for holding material, comprising:

providing a drum having a number of compartments including at least a first compartment and first and second ends and with a length defined between said first and second ends;

providing at least a first material holder;

moving said first material holder relative to said number of compartments to a first position for use in holding material for at least some time in said compartments;

inputting material into at least said first compartment at said first end of said drum while said drum is rotating; and outputting at least some of said material from said second end of said drum while said drum is rotating.

2. A method, as claimed in claim 1, wherein:

said moving includes adjusting at least a first fastener joined to said first material holder.

3. A method, as claimed in claim 1, further including:

replacing at least portions of said first material holder independently of said compartments.

4. A method, as claimed in claim 1, wherein:

said first end and said second end of said drum are at substantially the same vertical height during said inputting and said outputting.

5. A method, as claimed in claim 1, wherein:

said rotating of said drum during said inputting and said outputting occurs while said first material holder remains stationary.

6. A method, as claim for holding material, comprising:

providing a drum having a number of compartments including at least a first compartment and first and second ends and with a length defined between said first and second ends;

providing at least a first material holder; and moving said first material holder relative to said number of compartments to a first position for use in holding material for at least some time in said compartments, said moving includes moving said first material holder towards said first end to a second position.

7. A method for holding material, comprising:

providing a drum having a number of compartments including at least a first compartment and first and second ends and with a length defined between said first and second ends;

providing said first material holder relative to said number of compartments to a first position for use in holding material for at least some time in said compartments;

providing a second material holder; and moving said second material holder relative to said second end of said drum wherein at least portions of said second material holder are in contact with said second end of said drum.

8. A method for holding material, comprising:

providing a drum having a number of compartments including at least a first compartment and first and second ends and with a length defined between said first and second ends;

providing at least a first material holder;

moving said first material holder relative to said number of compartments to a first position for use in holding material for at least some time in said compartments;

providing a material; and causing said material to be received by said at least first compartment at said drum first end using a first filler and causing said material to be received by said first compartment at said drum second end using a second filler.

* * * * *